US006038790A

United States Patent [19]

Pyle et al.

[11] Patent Number: 6,038,790

[45] Date of Patent: Mar. 21, 2000

[54] FLEXIBLE SOLE WITH CUSHIONED BALL AND/OR HEEL REGIONS

[75] Inventors: Clifford L. Pyle, White Plains, N.Y.; John F. Ludemann, Boothbay Harbor, Me.

[73] Assignee: Nine West Group, Inc., White Plains, N.Y.

[21] Appl. No.: 09/031,562

[22] Filed: Feb. 26, 1998

[51] Int. Cl.[7] ..... A43B 13/12; A43B 13/18; A43B 23/00

[52] U.S. Cl. ..... 36/30 R; 36/28; 36/44

[58] Field of Search ..... 36/28, 31, 25 R, 36/43, 44, 30 R

[56] References Cited

U.S. PATENT DOCUMENTS

| | | | |
|---|---|---|---|
| D. 267,288 | 12/1982 | Davis | D2/320 |
| 1,741,419 | 12/1929 | Jones | 36/43 |
| 2,153,021 | 4/1939 | Margolin | 36/43 X |
| 2,168,485 | 8/1939 | Lyness | 12/142 |
| 2,182,022 | 12/1939 | Griswold | 36/72 |
| 2,182,256 | 12/1939 | Griswold | 12/142 |
| 2,207,632 | 4/1940 | Margolin | 36/44 X |
| 2,405,443 | 8/1946 | Mees | 36/30 |
| 2,491,280 | 12/1949 | Roth | 36/44 X |
| 2,502,774 | 4/1950 | Alianiello | 36/28 |
| 4,079,526 | 3/1978 | Fukuoka | 36/44 X |
| 4,316,335 | 2/1982 | Giese et al. | 36/129 |
| 4,494,320 | 1/1985 | Davis | 36/25 R |
| 4,794,707 | 1/1989 | Franklin et al. | 36/107 |
| 4,866,860 | 9/1989 | Blissett et al. | 36/28 |
| 4,897,936 | 2/1990 | Fuerst | 36/30 A |
| 4,930,232 | 6/1990 | Engle | 36/44 |
| 5,077,915 | 1/1992 | Gross | 36/31 |
| 5,092,060 | 3/1992 | Frachey et al. | 36/29 |
| 5,255,451 | 10/1993 | Tong et al. | 36/30 A |
| 5,311,677 | 5/1994 | Mann et al. | 36/44 X |
| 5,313,717 | 5/1994 | Allen et al. | 36/28 |
| 5,367,791 | 11/1994 | Gross et al. | 36/31 |
| 5,369,986 | 12/1994 | Frachey et al. | 36/29 |
| 5,435,077 | 7/1995 | Pyle | 36/28 |
| 5,435,078 | 7/1995 | Pyle | 36/30 R |
| 5,657,556 | 8/1997 | Bemis | 36/30 R |
| 5,815,949 | 10/1998 | Sessa | 36/28 X |
| 5,860,226 | 1/1999 | Graham et al. | 36/28 |

*Primary Examiner*—B. Dayoan
*Attorney, Agent, or Firm*—Senniger, Powers, Leavitt & Roedel

[57] ABSTRACT

A shoe sole has cushioning in ball and heel regions of the sole. The sole includes an insole which has openings in the ball and heel regions which increase the flexibility of the insole. The insole openings are filled in by a soft insole pad so that the insole does not form a barrier to cushioning the ball and heel of the foot. The outsole also has openings in ball and heel regions which are closed by clear covers. The openings provide for good flexibility of the outsole. A soft cushion is held in the cover for further cushioning of the ball and heel of the foot.

28 Claims, 8 Drawing Sheets

FLEXIBLE SOLE WITH CUSHIONED BALL AND/OR HEEL REGIONS

BACKGROUND OF THE INVENTION

This invention relates generally to shoe soles and more particularly to flexible shoe soles which have additional cushioning for the ball and/or heel of the foot.

A foot absorbs most of the load when walking or running in the ball and heel of the foot. The natural construction of the foot is well suited to absorb these forces when on relatively soft surfaces (e.g., grass or soft earth) or when the activity is relatively short in duration. However, when moving about on hard surfaces (e.g., roads and floors), particularly when the movement is sustained or high loads are encountered as in an athletic endeavor, the load becomes so great as to cause discomfort and injury to the foot. The location of the discomfort and injury is frequently one of the load bearing ball and heel regions of the foot.

The problem of protecting the ball and heel of the foot has been frequently addressed in the prior art by simply providing a shoe having additional cushioning in either or both the ball and heel regions of the shoe sole. However, the transmission of the cushioning effect to the foot has heretofore been limited. The cushions have been confined to the portions of the sole beneath the insole. The insole is a substantially rigid, hard piece constructed to withstand forces caused by connection of the upper which tend to deform the insole. As a result of the construction of the insole, the foot is significantly shielded from the cushioning effect by the insole. Moreover, the insole tends to inhibit flexibility of the shoe.

Although existing shoes provide substantial cushioning of the foot in the ball and heel regions, they tend to limit the foot's natural flexing motion when walking or running. The primary sources for rigidity of the shoe are the outsole and the insole. The outsole must be sufficiently robust to withstand the wear associated with contacting the ground. Generally speaking, the more robust materials tend to be less flexible. The insole tends to be rigid because it must withstand forces tending to deform the insole which are caused by the connection of the upper to the sole.

SUMMARY OF THE INVENTION

Among the several objects and features of the present invention may be noted the provision of a shoe sole which provides superior cushioning; the provision of such a shoe sole which cushions through the insole to the foot; the provision of such a shoe sole which permits the metatarsal heads of the foot to be cushioned at the insole; the provision of such a shoe sole which provides substantial cushioning for the ball and heel regions of the foot; and the provision of such a shoe sole which the provision of such a shoe sole which is highly flexible; and the provision of such a shoe having a robust construction.

Generally, an insole of the present invention comprises an insole board shaped to underlie a foot in a shoe which is constructed for securely mounting an upper of the shoe on the insole. An opening in at least one of the ball and heel regions of the insole board is filled by an insole pad made of a cushioning material. The insole pad is mounted on the insole board. The insole openings and insole pads provide flexibility of the insole and cushioning of the foot in said at least one region.

In another aspect of the present invention, a shoe has an upper and a sole. The sole includes an insole as described above.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
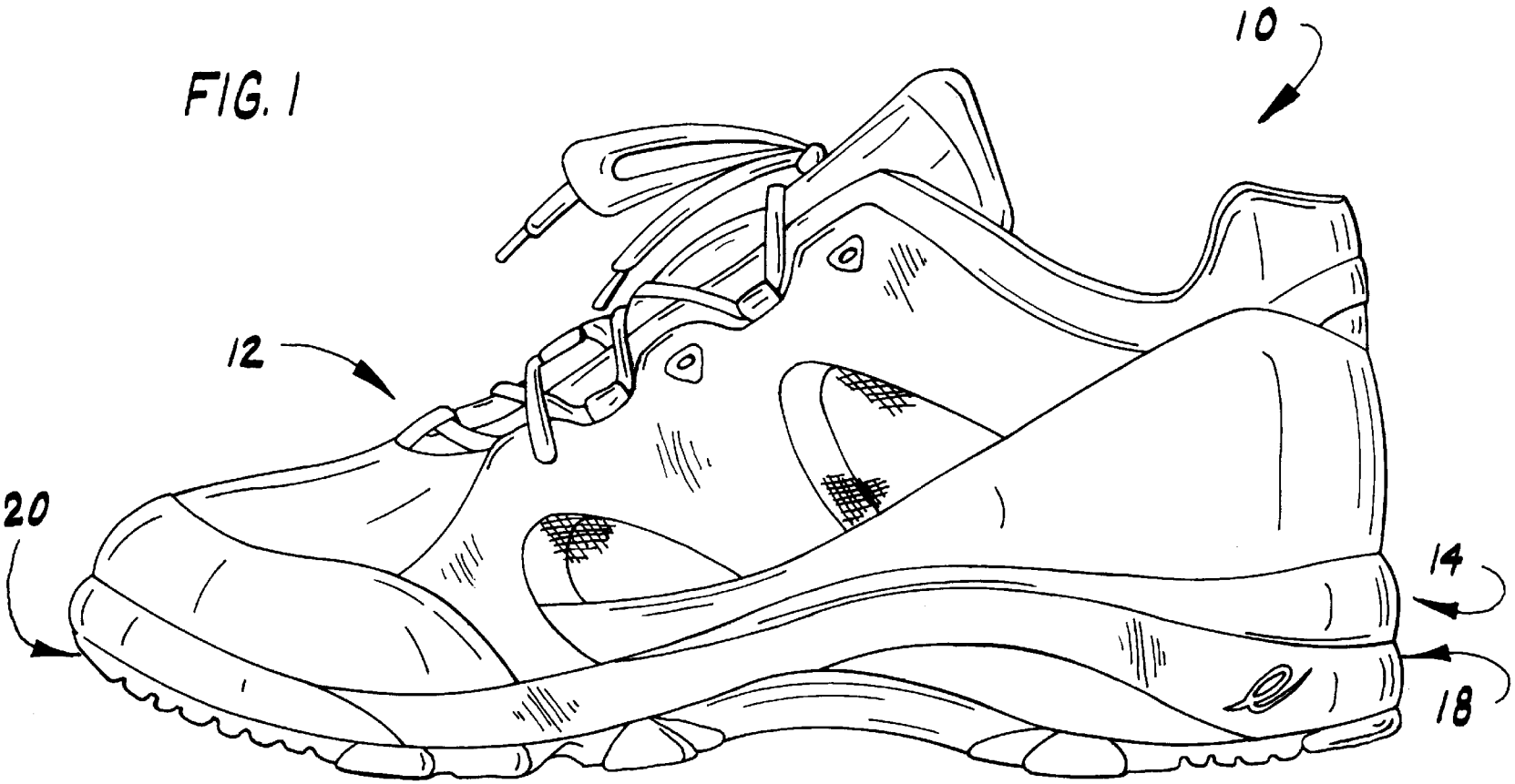
FIG. 1 is an elevational view of a shoe having a sole of the present invention.

Referring now to the drawings, a shoe constructed according to the principles of the present invention is designated generally by the reference numeral 10. As shown in FIG. 1, the shoe includes an upper 12 and a sole 14. The construction of the upper 12 shown in the drawings is an exemplary construction for an athletic shoe. It is to be understood that the upper may have other forms without departing from the scope of the present invention.

Figure 3:
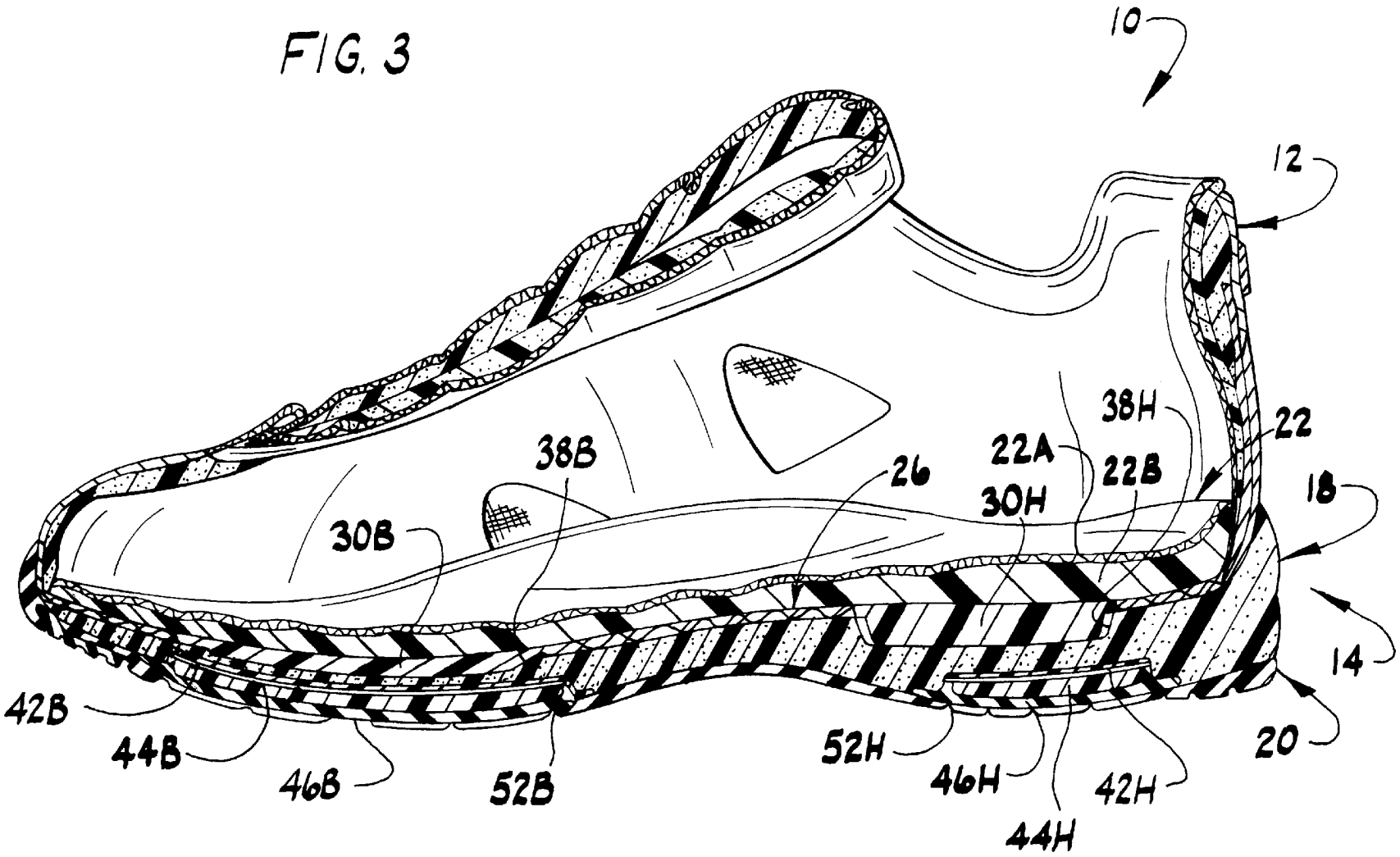
FIG. 3 is a longitudinal section of the shoe taken in the plane including line 3—3 of FIG. 2.
Figure 4:
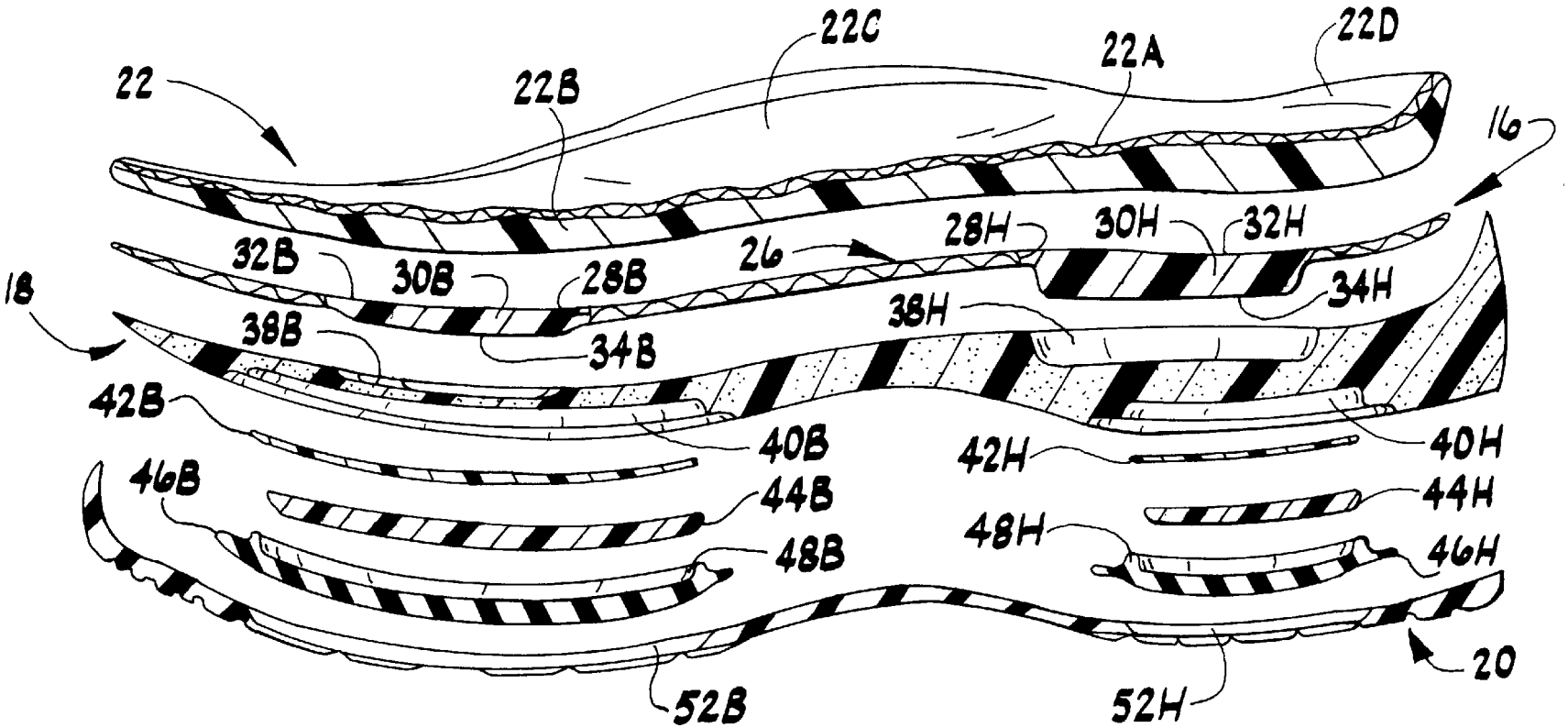
FIG. 4 is an exploded longitudinal section of the shoe sole and a sockliner.
Figure 5:
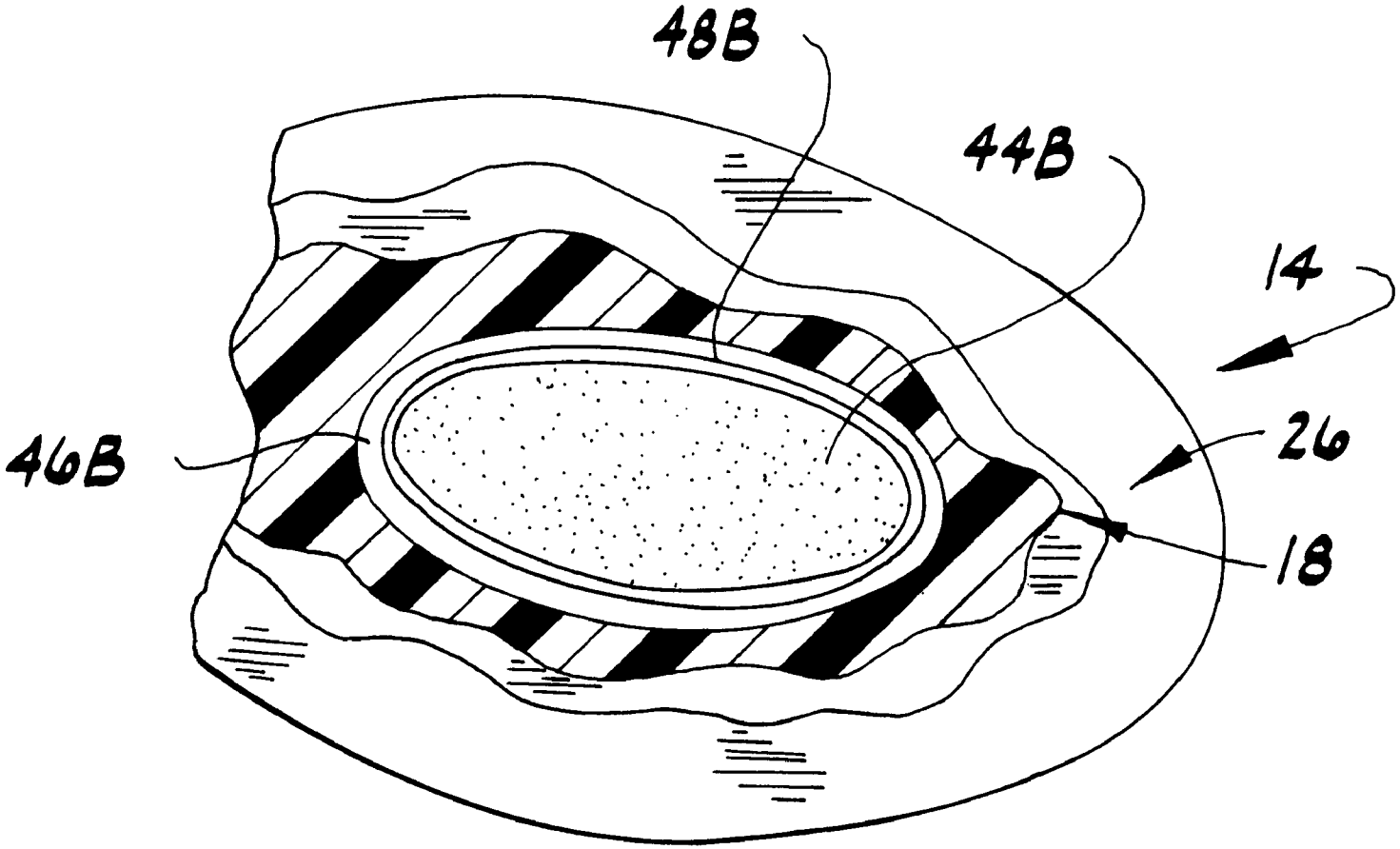
FIG. 5 is a fragmentary top plan view of the shoe sole with an insole and midsole partially broken away to show a cushion in a ball region of the shoe.

As shown in FIGS. 3 and 4, the sole 14 includes an insole 16, a midsole 18 and an outsole 20. A sockliner 22 disposed within the shoe 10 on top of the sole 14 has a cloth layer 22A for absorbing moisture and a cushioning layer 22B of polyether polyurethane material, substantially as disclosed in co-assigned U.S. application Ser. No. 08/792,873, filed Jan. 31, 1997, the disclosure of which is incorporated herein by reference. The sockliner 22 is formed to have an arch support 22C and a heel cup 22D for added support and stability.

Figure 8:
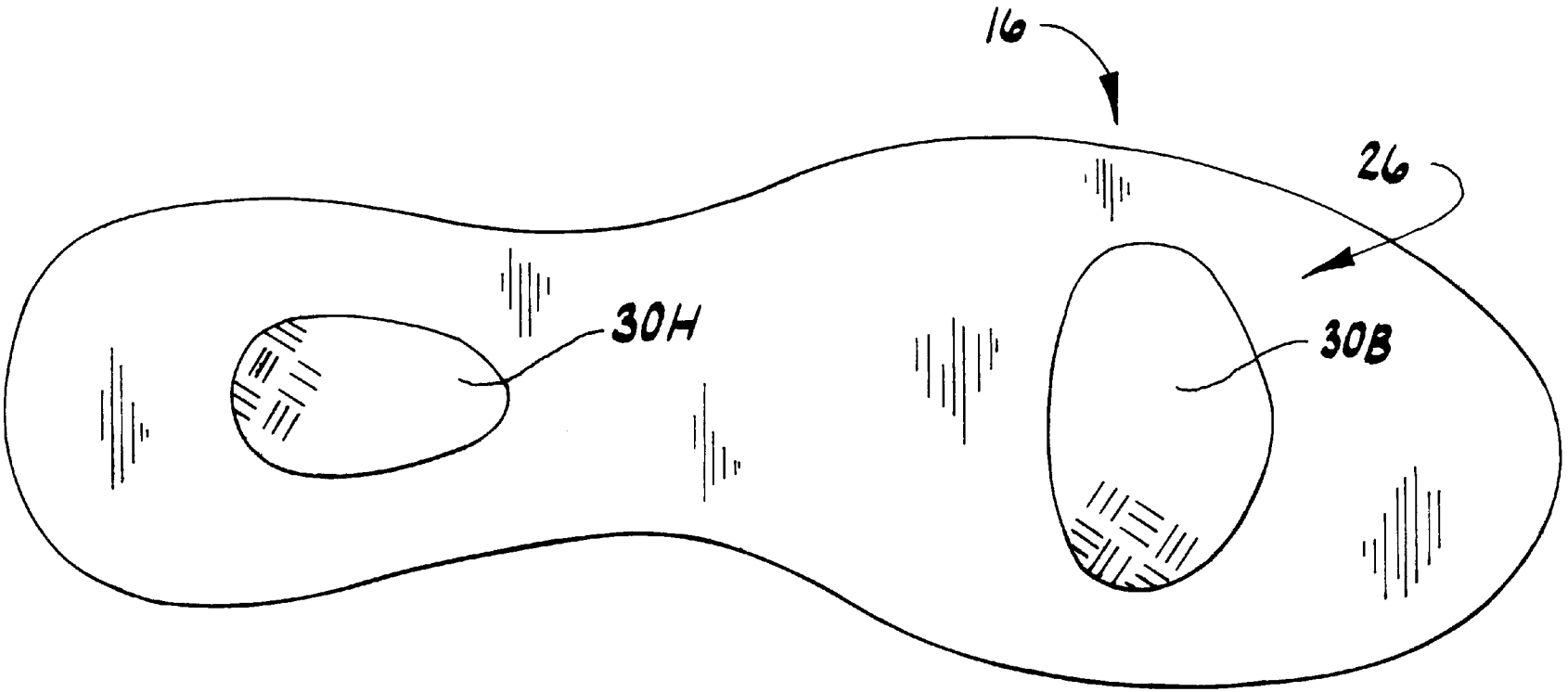
FIG. 8 is a bottom plan view of an insole of the shoe sole.

The insole 16 includes an insole board, generally indicated at 26, made of 1.5 mm thick nonwoven polyester and has openings 28B, 28H in ball and heel regions which extend completely through the insole board. Corresponding parts in the ball and heel regions of the shoe sole 14 will be designated by the same reference number followed by "B" or "H" to indicate their location in the ball or heel region of the sole. Use of the reference number without the letter suffix shall be taken to refer to either part. The insole openings 28B, 28H receive insole pads 30B, 30H made of a soft polyether type polyurethane having a durometer hardness preferably in the range of about 5 to 15 Shore C and a specific gravity of about 1.10±0.05. It is to be understood that other materials may be used for the insole 16 without departing from the scope of the present invention. The insole pads 30B, 30H are preferably molded into the openings 28B, 28H in the shoe manufacturing process. The molding process joins the insole pads 30B, 30H to the insole board 26. The insole pads 30B, 30H are each shaped so that upper portions 32B, 32H are substantially flush with the top of the insole board 26, but lower portions 34B, 34H extend below the bottom of the insole board (FIG. 4). As may be seen in FIG. 8, the heel insole pad 30H is elongate in a lengthwise direction of the insole 16, while the ball insole pad 30B is somewhat elongate in a transverse direction of the shoe. The ball insole opening 28B and ball insole pad 30B are shaped so that all of the metatarsal heads of the foot will lie within a tubular projection of the opening and over the insole pad when the shoe 10 is worn.

Figure 6:
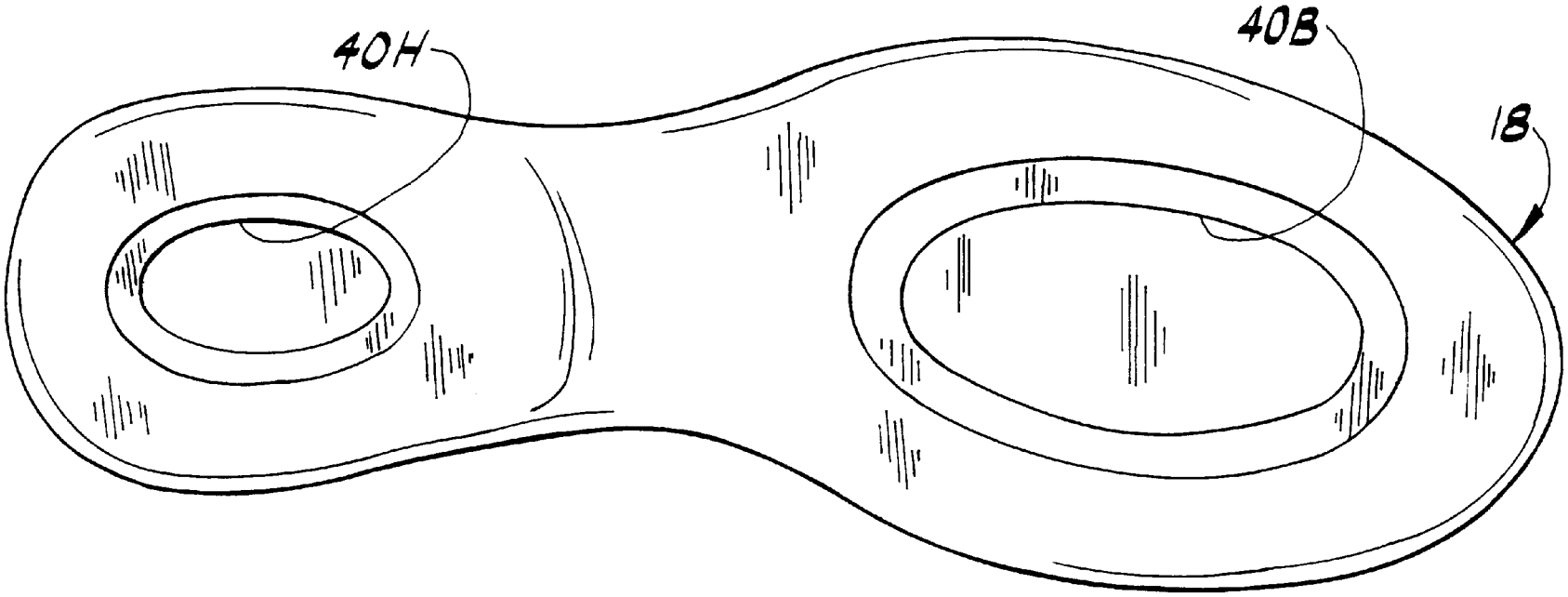
FIG. 6 is a bottom plan view of a midsole of the shoe sole.
Figure 7:
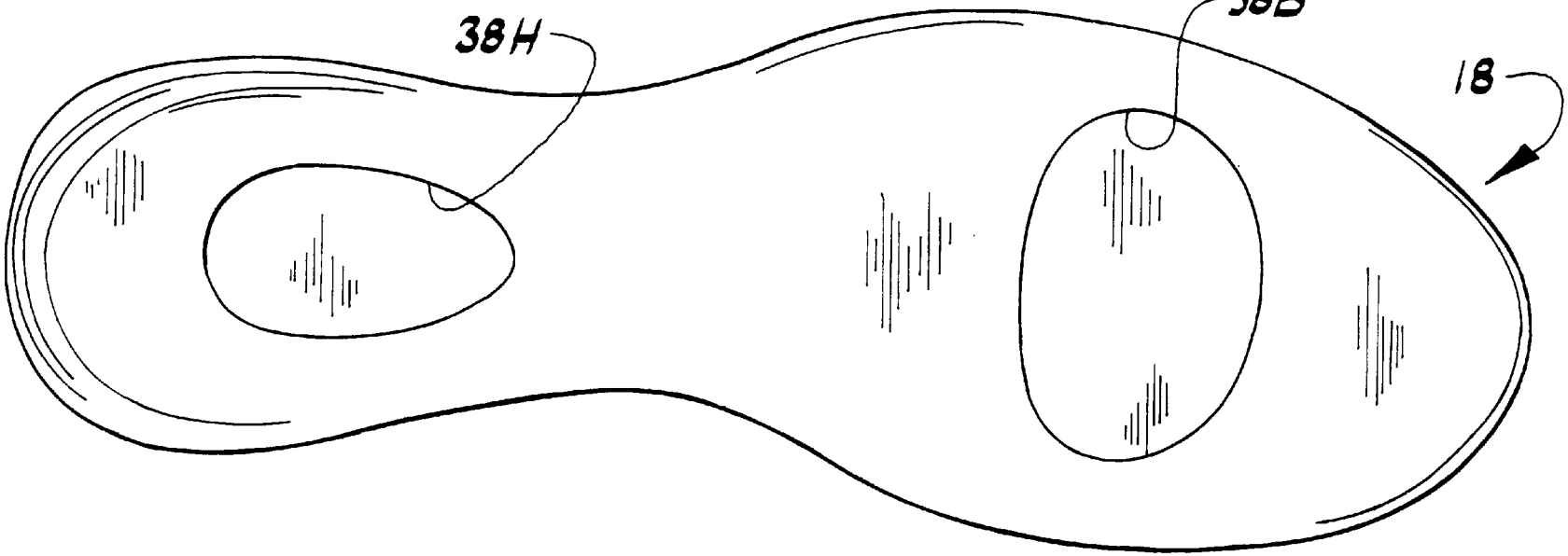
FIG. 7 is a top plan view of the midsole.

The insole board 26 is joined in a conventional manner, such as by bonding and stitching (not shown), to the midsole 18 formed of ELON. The midsole 18 is formed by a conventional ethylene vinyl acetate (EVA) process well known to those of ordinary skill in the art. However, the EVA base material is replaced with an ethylene-octene cross-linked foam, such as ENGAGE sold by DuPont Dow Elastomers in the United States. There are upper recesses 38B, 38H in ball and heel regions of the midsole 18 which receive the lower portions 34B, 34H of respective ones of the insole pads 30B, 30H below the insole board 26 so that the insole board lies substantially flush against the midsole (see FIG. 3). As shown in FIG. 7, the shape of each upper recess 38 corresponds to the shape of the respective insole pad 30 received in that recess. The bottom of the midsole 18 also has lower recesses 40B, 40H in the ball and heel regions which overlap, but are offset from corresponding ones of the upper recesses 38B, 38H in the top of the midsole. It will be noted that the midsole 18 forms a single continuous layer of the sole 14 and has no openings in it which pass entirely through the midsole (see FIGS. 6 and 7). Thin sheets 42B, 42H are fixed in the lower recesses 40B, 40H solely to provide a color (e.g., blue) background.

Cushions 44B, 44H are received in each of the lower recesses 40B, 40H of the midsole 18. Each cushion 44 has the appearance and feeling of a gelatin material (although the material will not flow) and preferably has a durometer hardness of less than about 10 Shore C. The cushion 44 is preferably made of a polyether polyurethane and has a specific gravity of about 1.05±0.05. The polyether polyurethane material is stirred as the cushion 44 is being formed to introduce relatively large air bubbles (on the order of 0.1–0.5 mm). The air bubbles are believed to enhance the cushioning provided by the cushion 44. The cushion 44B located in the ball region of the sole 14 has about the same thickness as the cushion 44H located in the heel region, but has a substantially larger surface area.

The cushion 44 in each midsole lower recess 40 is received in a central region of a corresponding transparent cover (46B or 46H). In the preferred embodiment, the cover 46 is preferably made of a natural rubber and styrene butadiene rubber compound having a specific gravity of about 1.15±0.02 and a durometer hardness of about 55 to 60 Shore C. However, the cover need not be transparent or made of the specific material recited herein to fall within the scope of the present invention. The central region is defined by an annular, upstanding flange (48B or 48H) of the cover 46. The flange (48B or 48H) holds the cushion 44 in place and also functions to contain the material forming the cushion when in liquid form prior to hardening.

Figure 2:
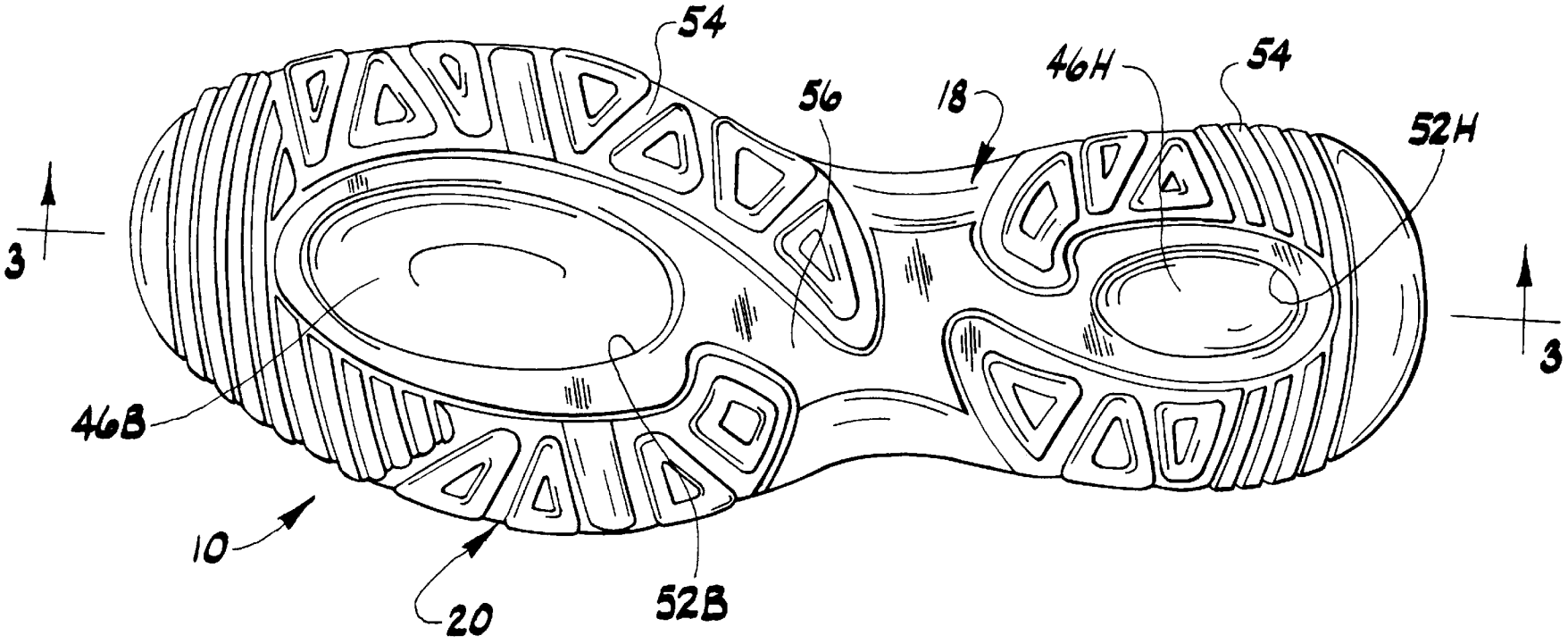
FIG. 2 is a bottom plan view thereof.

The outsole 20 is bonded to the midsole 18 where the two engage each other, and is preferably made of an abrasion resistant, opaque rubber material. In the illustrated embodiment, the outsole 20 is a single layer of uniform material having a hardness of about 55–60 Shore A and specific gravity of about 1.15±0.02. As shown in FIG. 3, there are two openings 52B, 52H in the outsole 20, one in the heel region and another in the ball region. The outsole 20 has outer portions 54 which engage the ground, and are characterized in the illustrated embodiment by generally triangular and rectangular treads, and by ribs (FIG. 2). A central portion 56 of the outsole 20, including portions surrounding the outsole openings is spaced above the plane of the outer portions 54 so that the central portion does not engage the ground. The outsole openings 52B, 52H are closed by the transparent covers 46B, 46H. A peripheral portion of each cover 46 rests on an upper surface of the outsole 20 around the outsole opening 52 (FIG. 3). The lower recesses 40B, 40H each have a larger section to receive the peripheral portion of the cover 46 and a smaller section which receives the flange 48 and cushion 44. The cover 46 extends into the outsole opening 52 but is spaced about 2 to 3 mm above the plane of the outer portions 54 of the outsole 20 which engage the ground.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A shoe insole in combination with a shoe sole, the insole having a ball region adapted to underlie the ball of a foot in a shoe and a heel region adapted to underlie a heel of the foot in the shoe, the insole comprising an insole board shaped to underlie a foot in a shoe, the insole board being constructed for securely mounting an upper of the shoe on the insole, an opening in the insole board, an insole pad made of a cushioning material mounted on the insole board and filling the opening thereby to provide flexibility of the insole and cushioning of the foot by the insole board, the shoe sole comprising an outsole including a ball region adapted to underlie the ball of the foot and a heel region adapted to underlie the heel of the foot, the outsole having an opening therein for increasing flexibility of the outsole.

2. A shoe insole in combination with a shoe sole as set forth in claim 1 wherein the opening in the insole board is disposed in the ball region of the insole and is shaped such that all metatarsal heads of the foot are disposed within the opening and over the insole pad when the insole underlies a foot in the shoe.

3. A shoe insole in combination with a shoe sole as set forth in claim 1 wherein the insole pad is bonded to the insole board by a molded connection of the insole pad material to the insole board.

4. A shoe insole in combination with a shoe sole as set forth in claim 3 wherein the insole pad has an upper portion substantially flush with an upper surface of the insole board and a lower portion projecting below a lower surface of the insole board.

5. A shoe insole in combination with a shoe sole as set forth in claim 4 wherein the insole pad has a durometer hardness between about 5 and 15 Shore C.

6. A shoe insole in combination with a shoe sole as set forth in claim 5 wherein the insole pad material has a specific gravity of about 1.1.

7. A shoe insole in combination with a shoe sole as set forth in claim 6 wherein the insole pad is made of a polyether polyurethane material.

8. A shoe insole in combination with a shoe sole as set forth in claim 1 wherein the opening comprises a first opening located in the heel region of the insole, the shoe insole further comprising a second opening in the ball region of the shoe, and another insole pad made of a cushioning material mounted on the insole board and filling the second opening thereby to provide flexibility of the insole and cushioning of the foot in the ball and heel regions.

9. A shoe insole in combination with a shoe sole as set forth in claim 1 wherein the opening in the insole board is located generally above the opening in the outsole.

10. A shoe insole in combination with a shoe sole as set forth in claim 9 further comprising a flexible cover closing the opening in the outsole, and a cushion located above the cover.

11. A shoe insole in combination with a shoe sole as set forth in claim 10 wherein the cushion has a durometer hardness of less than about 10 Shore C.

12. A shoe insole in combination with a shoe as set forth in claim 11 wherein the cushion is formed of a polyether polyurethane stirred upon formation of the cushion to introduce air bubbles into the cushion.

13. A shoe insole in combination with a shoe sole as set forth in claim 10 wherein the insole pad substantially overlies the cushion, and wherein the shoe sole further comprises a midsole extending between the insole pad and cushion.

14. A shoe insole in combination with a shoe sole as set forth in claim 13 wherein the midsole has an upper recess in a upper surface thereof receiving the insole pad therein, and a lower recess in a lower surface thereof receiving the cushion therein.

15. A shoe insole in combination with a shoe sole as set forth in claim 14 wherein the cover is made of a transparent material.

16. A shoe insole in combination with a shoe sole as set forth in claim 15 wherein the midsole is made of an ethylene octene cross-linked foam.

17. A shoe comprising an upper, and a sole attached to the upper, the sole having a ball region adapted to underlie the ball of a foot in a shoe, and a heel region adapted to underlie the heel of the foot in the shoe, the shoe sole including an insole and an outsole, the insole comprising an insole board shaped to underlie the foot in the shoe, the insole board being constructed for securely mounting the upper on the insole, an opening in the insole board, an insole pad made of a cushioning material mounted on the insole board and filling the opening thereby to provide flexibility of the insole and cushioning of the foot by the insole board, the outsole including a ball region adapted to underlie the ball of the foot and a heel region adapted to underlie the heel of the foot, the outsole having an opening therein for increasing flexibility of the outsole.

18. A shoe as set forth in claim 17 wherein the opening in the insole board is disposed in the ball region of the insole and is shaped such that all metatarsal heads of the foot are disposed within the opening and over the insole pad when the insole underlies a foot in the shoe.

19. A shoe as set forth in claim 17 wherein the insole pad is bonded to the insole board by a molded connection of the insole pad material to the insole board.

20. A shoe as set forth in claim 19 wherein the insole pad has an upper portion substantially flush with an upper surface of the insole board and a lower portion projecting below a lower surface of the insole board.

21. A shoe as set forth in claim 20 wherein the insole pad has a durometer hardness between about 5 and 15 Shore C.

22. A shoe as set forth in claim 17 wherein the opening comprises a first opening located in the heel region of the insole, the shoe insole further comprising a second opening in the ball region of the shoe, and another insole pad made of a cushioning material mounted on the insole board and filling the second opening thereby to provide flexibility of the insole and cushioning of the foot in the ball and heel regions.

23. A shoe as set forth in claim 17 further comprising a flexible cover closing the opening in the outsole, and a cushion located above the cover.

24. A shoe as set forth in claim 23 wherein the cushion is formed of a polyether polyurethane stirred upon formation of the cushion to introduce air bubbles into the cushion.

25. A shoe as set forth in claim 23 wherein the cushion has a durometer hardness of less than about 10 Shore C.

26. A shoe as set forth in claim 23 wherein the insole pad substantially overlies the cushion, and wherein the shoe further comprises a midsole extending between the insole pad and cushion.

27. A shoe as set forth in claim 26 wherein the midsole has an upper recess in a upper surface thereof receiving the insole pad therein, and a lower recess in a lower surface thereof receiving the cushion therein.

28. A shoe as set forth in claim 17 wherein the opening in the insole board is located generally above the opening in the outsole.

* * * * *